United States Patent [19]

Ishii et al.

[11] Patent Number: 4,973,500

[45] Date of Patent: Nov. 27, 1990

[54] METHOD OF PLATING METAL SHEETS BY PASSING THE SHEET UPWARDS IN CLOSE PROXIMITY TO AN UPWARDLY DIRECTED NOZZLE

[75] Inventors: Toshio Ishii; Shunichi Sugiyama; Yasuhisa Tajiri; Michitaka Sakurai, all of Tokyo, Japan

[73] Assignee: NKK Corporation, Tokyo, Japan

[21] Appl. No.: 421,517

[22] Filed: Oct. 13, 1989

[30] Foreign Application Priority Data

| | | | |
|---|---|---|---|
| Oct. 19, 1988 | [JP] | Japan | 63-261639 |
| Oct. 19, 1988 | [JP] | Japan | 63-261641 |
| Oct. 20, 1988 | [JP] | Japan | 63-262947 |
| Oct. 21, 1988 | [JP] | Japan | 63-264086 |

[51] Int. Cl.[5] ..... B05D 1/26

[52] U.S. Cl. ..... 427/436; 427/295; 427/349; 427/376.8; 118/410; 118/411; 118/63

[58] Field of Search ..... 427/295, 349, 376.8, 427/383.7, 436; 118/410, 411, 412, 429, 74, 62, 63; 164/80, 469

[56] References Cited

U.S. PATENT DOCUMENTS

| | | | |
|---|---|---|---|
| 3,062,181 | 11/1962 | Beguin | 118/410 X |
| 3,066,041 | 11/1962 | Busch | 118/74 |
| 3,081,535 | 3/1963 | Lincoln | 118/410 X |
| 3,916,043 | 10/1975 | Fowble | 118/410 |
| 4,283,443 | 11/1981 | Choinski | 118/411 X |
| 4,445,458 | 5/1984 | O'Brien | 118/410 X |
| 4,566,624 | 1/1986 | Comerford | 118/410 X |

*Primary Examiner*—Shrive Beck
*Assistant Examiner*—Alain Bashore
*Attorney, Agent, or Firm*—Henry C. Nields

[57] ABSTRACT

An inventive method may perform a plating the surface of the metals sheet without using a molten plating metal. This method successively melts a supplied solidus plating metal in close proximity of the passing metal sheet and adheres the molten plating metal as a plating film to the surface of the metal sheet, where the metal sheet passes upwardly and the plating metal is supplied through an upwardly-directed nozzle disposed near the passing sheet, and when or immediately before the plating metal is supplied from the nozzle, it is molten by a heat melting means. The molten plating metal forms a pool at a corner defined between the surface of the passing sheet and the tip of the nozzle, and the molten metal of the pool forms a plating adheres to the sheet surface and forms the plating film.

60 Claims, 10 Drawing Sheets

METHOD OF PLATING METAL SHEETS BY PASSING THE SHEET UPWARDS IN CLOSE PROXIMITY TO AN UPWARDLY DIRECTED NOZZLE

TECHNICAL FIELD OF THE INVENTION

The present invention relates to a method of continuously plating metal sheets on surfaces without employing a molten metal bath.

BACKGROUND OF THE INVENTION

A widely known method of forming a plating film on a steel strip surface may include a hot dip method of immersing a steel strip into a molten plating metal.

In a continuous hot dip zinc plating of this type, a steel strip is carried out with a thermal treatment in a pre-heating furnace and a surface cleansing treatment, subsequently immersed into a molten zinc bath so as to form a plating film thereon, drawn out of the bath, adjusted in an amount of plating adhesion by squeezing gases, and performed with a surface treatment by means of a galvannel or the like.

Thus obtained molten metal plated steel sheets have more beautiful, and are excellent in an anti-corrosive property, and hence such steel sheets are widely used.

There have arisen, however, many problems involved in the conventional hot dip zinc plating methods because of using a plating bath. In recent years, it has been required that the steel strip be more uniform, smoother and finer on the surface than ever before, particularly in the application of external sheets to automobiles, house electric appliances and so on.

Besides, there are increasingly demands for new products of thickness-differential plating or one-side plating in terms of types thereof. For this reason, there appear problems about quality of the plated steel strip based on the conventional hot dip method or peculiar to the process itself. Some of the problems will be given as follows.

(1) Fe elutes from the steel strip surface into the plating bath, or so-called dross is much generated due to oxidation of a plating metal. The dross has to be scooped up and removed, but the metal is lost thereby other than adhered to the steel strip.

(2) The dross is produced in the plating bath, or dusts of bricks composing a pot are mixed in the bath. Thus, impurities are easily mixed in the plating bath and adhered to the steel strip, thereby degrading the appearance thereof.

(3) Plating matrix components to be put into the plating bath, the components adhered to the strip, and trace elements contained in the components to be exhausted outwardly of the plating bath are different from each other. It is therefore difficult to control them to be plating bath components containing necessary elements as desired.

The above mentioned matters result in inferior plating adhesion and poor alloying of a galvannel material, and also various plating defects.

(4) It is required that mechanical members such as rolls for passing the steel strip, arms for supporting the rolls and bearings are immersed into the metal plating bath having a high temperature and high anti-corrosive property.

This causes problems in which those mechanical members are corroded, the concomitant dross is generated therewith, and the plating surface is degraded in appearance due to the corrosion caused in the roll surfaces in the bath.

In addition, the time for the operation stop is needed for periodically repairing and replacing the corroded or damaged parts of the mechanical members, and productive abilities of the apparatus cannot be effectively exhibited to a possible maximum.

(5) Grooves chased in the rolls are easily translated onto the plating surface by using the steel strip passing rolls in the plating bath, thereby degrading the appearance thereof.

(6) The workers bear burdens and are exposed to dangerous situations when removing bottom drosses accumulated on the lower part of the bath and top drosses accumulated on the bath surface, initially passing the steel strip into the bath, repairing the rolls in the plating bath, and performing the operations at high temperatures around the large plating bath.

(7) Since one kind of platings is operated per one pot, and when carrying out different plating processes, it is necessary to replace the bath by scooping, or prepare beforehand the pot in which a heterogeneous plating metal is molten, followed by shifting the pot.

(8) In a case of producing a double-side plating material and a one-side plating material by a single equipment, the plating equipment in the pot unit is needed to be changed. This requires a good deal of time and labors in addition to burdens in the equipment for this purpose.

(9) It is difficult to process special platings such as double-side heterogeneous plating, multi-layered plating, double-side thickness differential plating or the like.

In contrast with the above mentioned conventional hot dip method, there is proposed a hot dip method in Japanese Patent Specification Laid-Open No. 61-207555, where a nozzel is made close to a surface of a travelling steel strip, a molten metal supplied from a tank is sucked by the nozzle by a wet adhesivity between the molten metal and the steel strip surface, and the molten metal is then adhered to the steel strip.

This method makes use of a technique of coating a paint having a high viscosity. The method feeds the molten metal from the tank to the nozzle, in which an amount of plating adhesion is controlled in accordance with a head pressure of the molten metal tank. As a result, variations in a bath level within the tank appear as scattering in amount of plating adhesion. This makes bad an accuracy relative to the amount of plating adhesion. In any case, a molten metal tank similar to the dipping plating bath is required, so that the above mentioned various problems appear.

As discussed above, the conventional hot dip method brings various problems.

In view of such circumstances, it is an object of the invention to provide a new plating method which may continuously plate a metal plate without employing the conventional molten metal bath, and control an amount of palting adhesion with a high accuracy.

DISCLOSURE OF THE INVENTION

The present invention provides a plating method of metal sheets by use of a plating metal supplying device having an upward nozzle, comprising the steps of: passing upwards a metal sheet to be plated in close proximity to one side edge of an upwardly-directed nozzle; successively melting a solidus plating metal from the top end of or just before a port of the nozzle by a heat melting mean while successively feeding the solidus plating metal toward the nozzle port within the device; discharging the molten plating metal from the nozzle port so as to form a pool of the molten plating metal at a corner defined by a metal plate surface and a tip of the nozzle; adhering the plating metal of the metal pool to the surface of the passing metal sheet, thereby forming a plating film thereon.

A greatest feature of the invention is that the solidus plating metal is molten by an amount of an estimated plating just before plating, and the thus molten material is plated. This manner extremely facilitates handling of the plating metal and also controls an amount of adhesion in comparison with the above mentioned method in Japanese Patent Specification Laid-Open No. 61-207555.

Another feature of the invention is not that the molten plating metal is supplied directly to the metal sheet surface but that the metal pool is temporarily formed at the corner between the nozzle tip and the metal sheet by the balance between a surface expansion and a pressure, and the plating is formed while the plating metal of the pool is upheaved by an upwardly passing metal sheet. In a system of supplying the molten plating metal per se directly to the metal sheet surface by use of the nozzle, not depending upon the above mentioned method, a metal supplying amount (onto the metal sheet surface) from the nozzle is determined depending upon a clearance formed between the nozzle tip and the sheet surface. It is therefore required that the clearance be extremely small to be substantially equivalent to the thickness of the plating film. The metal sheet is, however, inevitably somewhat vibrated during passing, and it is not easy to maintain constant the fine clearance in relation with the nozzle due to the bad shapes of the sheet, and this causes non-uniformity in the plating thickness and troubles due to impingement of the nozzle upon the sheet. On the contrary, according to the invention, the metal supplying amount does not depend upon the clearance between the nozzle and the sheet surface, thereby obtaining a uniform thickness with stability, irrespective of the above mentioned clearance. The clearance may be diminished within a range enough to form a metal pool. As a result, it is possible to provide a wide clearance enough to prevent the impingement of the nozzle upon the sheet.

The above mentioned invention may take various kinds of embodiments as follows.

(i) It is an object of the invention to provide a plating method of a metal sheet by use of a plating metal supplying device having a heat melting mechanism of plating metal and a discharge nozzle at its top end, comprising the steps of: passing upwards a metal sheet to be plated in close proximity to one side edge of an upwardly-directed discharge nozzle; successively melting a solidus plating metal from the top ends thereof just before a port of the discharge nozzle by the heat melting means while successively feeding the solidus plating metal towards the discharge nozzle port within the device; discharging a resultant molten plating metal from the discharge nozzle port; forming a pool of the molten plating metal at a corner defined by a metal sheet surface and a tip of the discharge nozzle; adhering the molten plating metal of the pool to the surfce of the pasing metal sheet; and forming a plating film thereon.

(ii) It is another object of the invention to provide a plating method of a metal sheet by use of a plating metal supplying device having a heat melting mechanism of plating metal and a discharge nozzle at its top end, comprising the steps of: passing upwards a metal sheet to be plated in close proximity to one sdie edge of an upwardly-directed discharge nozzle; successively melting a solidus plating metal from the top ends thereof just before a port of the discharge nozzle by the heat melting means while successively feeding the solidus plating metal towards the discharge nozzle port within the device; discharging a resultant molten plating metal from the discharge nozzle port; blowing a gas having a temperature higher than a melting point of the plating metal on the discharged molten plating metal in the direction of a metal sheet from the side of the discharge nozzle port; carrying away the molten plating metal towards the metal sheet; forming a pool of the molten plating metal at a corner defined by a metal sheet surface and a tip of the discharge nozzle; adhering the molten plating metal of the pool to the surface of the passing metal sheet; and forming a plating film thereon.

(iii) It is a further object of the invention to provide a plating method of a metal sheet by use of a plating metal supply device having a preheat means of plating metal and the supply nozzle at its top end, comprising the steps of: passing upwards a metal sheet to be plated in close proximity to one side edge of an upwardly-directed discharge nozzle; feeding the plating metal to a supply nozzle while preheating the plating metal by the preheating means the supply device; supplying the solidus plating metal from a nozzle port; blowing a gas having a temperature higher than a melting point of the plating metal on the supplied plating metal in the direction of the metal sheet from the side of the supply nozzle port to melt the plating metal; carrying away a resultant molten plating metal in the direction of the metal sheet; forming a pool of the molten plating metal at a corner defined by a metal sheet surface and a supply nozzle tip; adhering the molten plating metal of the pool to the sheet surface; and forming a plating film thereon.

(iv) It is a still further object of the invention to provide a plating method of a metal sheet by use of a plating metal supply device having a preheat means of plating metal and a supply nozzle, comprising the steps of: passing upwards a metal sheet to be plated in close proximity to one side edge of an upwardly-directed supply nozzle; feeding the plating metal to the supply nozzle port while preheating the plating metal by the preheating means with in the supply device; supplying the solidus plating metal from the nozzle port; successively melting the supplied plating metal by means of a heat melting means provided outwardly of the nozzle port; blowing gas having a temperature higher than a melting point of the plating metal on a resultant molten plating metal in the direction of a metal sheet; forming a pool of the molten plating metal at a corner defined by a surface of the metal sheet and a tip of the supply nozzle; adhering the molten plating metal of the pool to the metal sheet surface; and forming a plating film thereon.

(v) It is another object of the invention to provide a plating method of a metal plate, in which plating metal is molten by blowing a high temperature gas thereon in combination with a heat melting means by use of a metal supply device having a preheat means for plating metal and the supply nozzle at its top end; comprising the steps of: passing upwards a metal sheet to be plated in in close proximity to one side edge of an upwardly-directed supply nozle; feeding the molten plating metal to the supply nozzle port while preheating the plating metal by the preheat means within the supply device; suppying the solidus plating metal from a nozzle port;

heating the supplied plating metal by means of the heat melting means provided outwardly of the nozzle port; blowing a gas having a temperature higher than a melting point of the plating metal in the direction of the metal sheet from the side of the supply nozzle port, thus melting the plating metal; carrying away a resultant molten metal with the high temperature gas in the direction of the metal sheet; forming a pool of the molten plating metal at a corner defined by a surface of the metal sheet and a tip of the supply nozzle; adhering the molten plating metal of the pool to the surface of the passing metal sheet; and forming a plating film thereon.

(vi) It is another object of the invention to provide a plating method of a metal sheet by use of a plating metal supply device having a heat melting means for plating metal and the discharge nozzle at its top end, comprising the steps of: passing upwards a metal sheet to be plated in close proximity to one side edge of an upwardly-directed discharge nozzle; successively melting the solidus plating metal from the top ends thereof just before a port of the discharge nozzle by the heat melting means while successively feeding the solidus plating metal towards the discharge nozzle port within the supply device; discharging a resultant molten metal from the discharge nozzle port; forming a pool of the molten plating metal at a corner defined by a metal sheet surface and a tip of the discharge nozzle; adhering the molten plating metal of the liquid pool, as a plating film, to the surface of passing the metal sheet; and sucking-discharging a gas outside which exists in a space between the metal sheet and the discharge nozzle under the pool during the plating process.

(vii) It is the other object of the invention to provide a plating method of a metal sheet by use of a plating metal supply device having a heat melting means of plating metal and the discharge nozzle at its top end, comprising the steps of: passing upwards a metal sheet to be plated in close proximity to one side edge of an upwardly-directed discharge nozzle as contacting its rear side to a rotary member at a periphery velocity in synchronism with the passing speed of the metal sheet; successively melting the solidus plating metal from the top ends thereof just before a port of the discharge nozzle by the heat melting means while successively feeding the solidus plating metal towards the discharge nozzle port within the supply device; discharging a resultant molten plating metal from the discharge nozzle port; forming a pool of the molten plating metal at a corner defined by a metal sheet surface and a tip of the discharge nozzle; adhering the molten plating metal of the pool to the surface of the passing metal sheet; and forming a plating film thereon.

The featrues of the above mentioned methods (ii) to (v) are present in that a high temperature gas is blown on the plating metal fed from the nozzle in the direction of the metal sheet from the side of the nozzle. Thereby, a melting condition of the plating metal becomes uniform crosswise, and the molten plating metal can be supplied in the width of the metal sheet at a constant velocity of flow. Namely, uneveness in melting the plating metal is more or less inevitable. If the molten plating metal is made flow naturally towards the steel sheet without blowing the high temperature gas as in the invention, the melting condition becomes non-uniform, and the velocity of metal flow is not thereby constant. Consequently, the plating is formed with uneveness in the length (in the direction of the sheet line), which in turn brings about non-uniformity in amount of adhesion. In accordance with the invention, however, the metal melting is made uniform crosswise by a gas blow and is controlled at a constant velocity of flow whereby uniform plating can be performed. In accordance with the methods (iii) and (v), the high temperature gas acts to melt the plating metal in addition to the above mentioned functions. The plating metal can be molten more uniformly than ever before particularly in the system of melting the plating metal with the high temperature gas alone.

The feature of the method (vi) lies in that a gas staying under the liquid metal pool is sucked and exhausted outside, thereby properly preventing the gas from invading into the plating film.

The feature of the method (vii) lies in that a rotary body is contacted with the underside of the steel strip of a plating treatment unit, and a plating process can thereby be practised by preventing the vibrations of the metal plate.

BRIEF DESCRIPTION OF THE DRAWINGS

FIG. 1 is a whole explanatory view, and FIG. 2 is a partially enlarged view illustrating, a plating treatment unit;

FIG. 7 is a partially enlarged view illustrating a plating treatment unit;

FIG. 8 is a whole explanatory view, and FIG. 9 is a partially enlarged view illustrating a plating treatment unit;

FIG. 10 is a whole explanatory view, and FIG. 11 is a partially enlarged view illustrating a plating trewatment unit;

FIG. 12 is a whole explanatory view, and FIG. 13 is a partially enlarged view illustrating a plating treatment unit;

FIG. 14 is a whole explanatory view, and FIG. 15 is a partially enlarged view iullustrating a plating treatment; and, FIG. 16 is an explanatory view showing an embodiment of the invention.

DETAILED DESCRIPTION OF THE INVENTION

Figure 1:
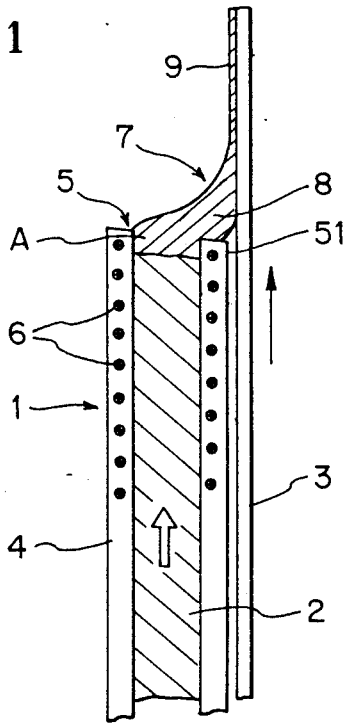
FIGS. 1 and 2 show embodiments of the invention, where
Figure 2:
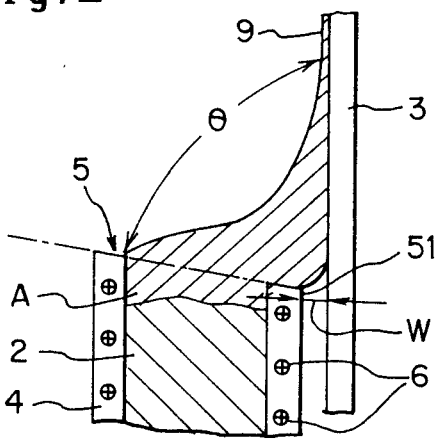

FIGS. 1 and 2 illustrate embodiments in which a plating method is applied to a continuously plating process of a steel strip. The reference numeral 1 designtes a plating metal supplying device; 2 is a plating metal; and 3 is a steel strip plated to be passed.

The plating metal supplying device 1 includes a guide member 4 for guiding upwards themetal material 2 of a solidus (sheet shape in this embodiment). The guide member 4 has an upwardly-directed discharge nozzle 5 at its top end (upper end) for discharging the molten plating metal. The guide member 4 is composed of a cylindrical body oblong in section in this embodiment. The top end of the guide member 4 is provided with a heat melting means comprising a heating member 6 (a heater or the like) for melting a plating metal.

The plating metal supplying device 1 has a feed mechanism (not illustrated) comprising a feed roller or a cylinder unit for feeding the solidus plating metal 2 to the discharging nozzle.

The steel strip 3 passes upwards in close proximity to one side edge 51 of the upwardly-directed discharge nozzle 5 with respect to the plating metal supply device 1. On the other hand the solidus plating metal 2 is successively fed towards the discharge nozzle within the supply device 1. Subsequently, the materials 2 are molten in due order from the top ends thereof just before a port of the discharge nozzle, and discharged from the discharge nozzle 5.

The dischargeed molten plating metal (A) forms a pool of a liquid metal 8 at a corner 7 defined by a tip of the discharge nozzle and a surface of the steel strip. The molten plating metal (A) of the pool 8 is adhered so as to be upheaved by the steel strip 3 moving upwardly, thus forming a plating film 9.

A gap between the side edge 51 of the discharge nozzle and the steel strip 3 is to be narrowed down to the strip so that the molten metal (A) of the pool 8 does not drop down from the gap. If the gap is excessively small, however, the nozzle will impinge upon the steel strip. For this reason, a gap (W) is set preferably within a range of 0.5–5 mm.

Figure 3:
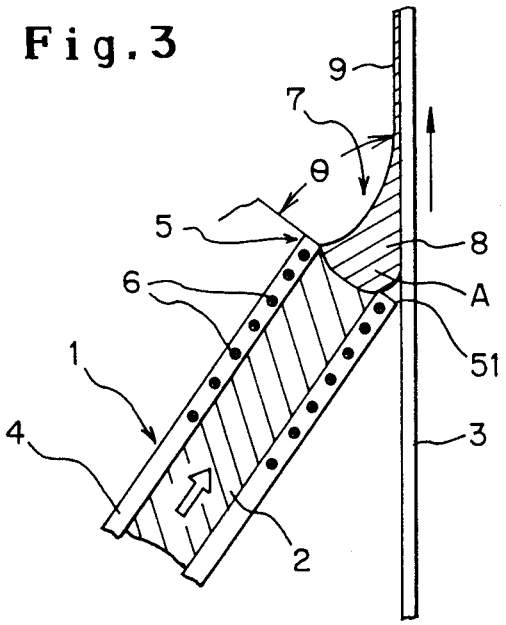
FIGS. 3, 4 and 5 are explanatory views illustrating other embodiments of the invention.

The steel strip 3 and the nozzle tip define a corner 7, an angle $\theta$ of which can properly be selected. FIG. 3 illustrates an example where the discharge nozzle 5 is inclined, while the angle $\theta$ of the corner 7 is diminished.

A direction in which the steel strip 3 passes is not necessarily vertical. The steel strip 3 can pass obliquely upwards within such a range adequately forming the molten metal pool 8.

Figure 4:
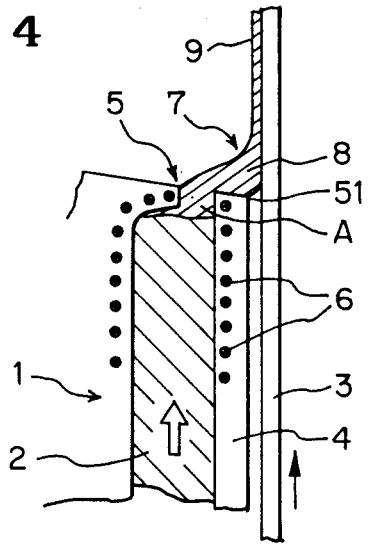

Inner diameters of the guide memebr 4 and of the discharge nozzle 5 are not necessarily equal to each other. The nozzle may be formed smaller in diameter than the guide member 4 as shown in FIG. 4.

Figure 5:
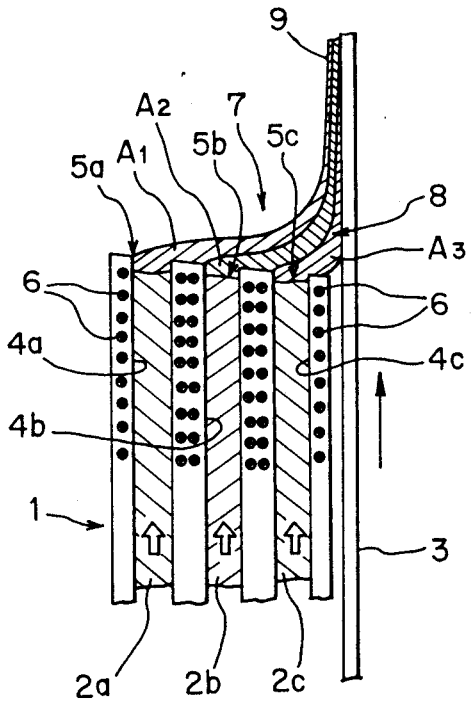

FIG. 5 illustrates one example where the plating method of the invention is applied to production of a multi-layered plating steel plate. Provided in the thickness of the steel strip are a plurality of guide members 4*a*–4*c* to which plating metals 2*a*–2*c* are fed, and these plating metals are molten and discharged from discharge nozzles 5*a*–5*c*, respectively. With this arrangement, the pools are formed in that the plating metals A1–A3 are layered. Laminated plating films of the plating metals or plating metal components are distributed obliquely in the thickness, whereby so-called oblique component plating films are obtained. Some structural devices are, as the cases may be, made by providing, for example, a weir plate on the way to the metal pool 8. It is possible to acquire plating films having uniform components where three kinds of components are mixed substantially uniformly.

FIGS. 6 to 16 show various kinds of embodiments of the invention.

Figure 6:
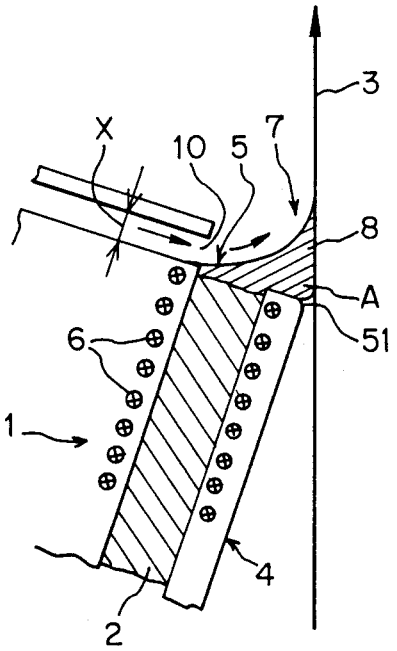
FIGS. 6 and 7 show further embodiments of the invention, where
Figure 7:
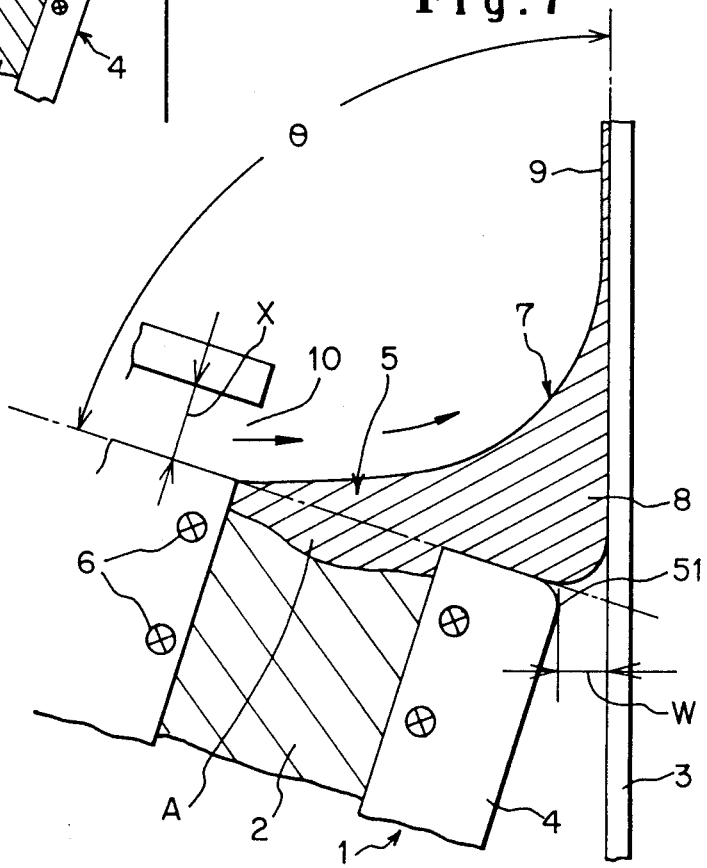

FIGS. 6 and 7 show the embodiments where a high temperature gas is blown from the side of the nozzle 5.

A ags supply port 10 is formed in a position opposite to the side on which a steel strip passes, with the discharge nozzle interposed therebetween, facing to a nozzle port from which a molten plating metal (A) is discharged and undergoes a blow of a high temperature ags in the direction of the steel strip. A slit width of the supply port 10 is set generally to 2–50 mm.

A gas having a temperature higher than a melting point of the plating metal is blown from a gas supply port 10 on the molten plating metal (A). With a blow of the high temperature gas, the molten plating metal (A) is forcibly carried away towards the steel strip 3 at a constant velocity of flow without being solidified, thus forming a metal pool 8 at a corner 7 defined by the tip of the discharge nozzle and the steel strip surface. The molten plating metal (A) of the pool 8 is adhered so as to be upheaved by the upwardly moving steel strip 3, thus forming a palting film 9.

The steel strip 3 and the nozzle tip define the corner 7, an angle $\theta$ of which can be properly selected. For instance, the discharge nozzle 5 is inclined, while the angle $\theta$ of the corner 7 can be decreased.

A direction of blowing of the high temperature gas from the gas supply port 10 is not limited to the one parallel with a face of the nozzle port. If a large angle to the nozzle port face is made in the blowing direction, large splushes are caused in the molten plating metal. This causes deterioration in surface condition of the plating film.

The contents of others are the same as stated concerning that of the embodiment of FIG. 1.

Figure 8:
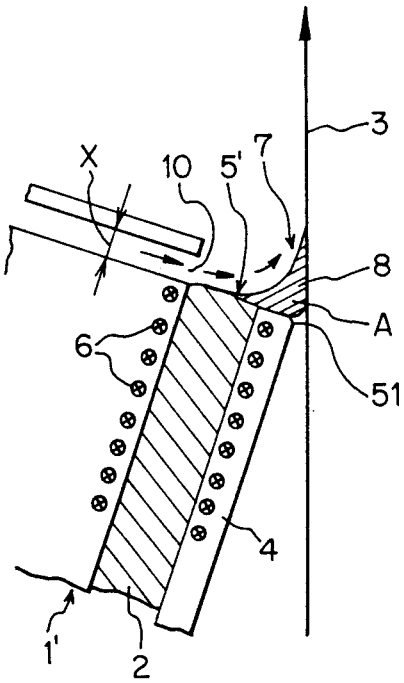
FIGS. 8 and 9 show still further embodiment of the invention, where
Figure 9:
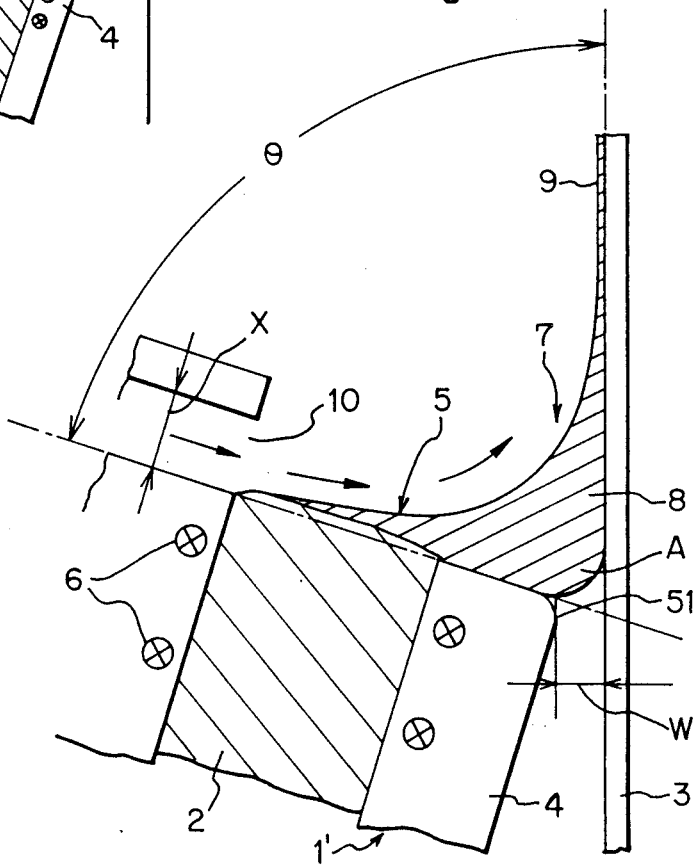

FIGS. 8 and 9 show that the high temperature gas for controlling a velocity of flow of the molten palting metal, while FIG. 6 shows that the plating metal 2 is molten just before the nozzle port by the heat melting means.

A plating metal supply device 1' includes a supply nozzle 5' for supplying the plating metal as it remains solidus at a top end of the guide member 4. The top end of the guide member 4 is mounted with a preheat mechanism, composed of a heating body 6 (a heater or the like), for preheating the plating metal.

Formed, similarly as FIG. 6, in a position opposite to a steel strip passing side with the supply nozzle 5' interposed therebetween is a ags supply port facing to a nozzle port from which the plating metal is supplied and undergoes a blow of a high temperature gas in the direction of the steel strip.

Other constitutions are the same as shown in FIGS. 6 and 7.

The steel strip 3 passes upwards in close proximity to one side edge 51 of the upwardly-directed supply nozzle 5' with respect to the plating metal supply device 1'. On the other hand, the solidus plating metal is successively fed towards the supply nozzle port within the supply device 1' and preheated by the preheat mechanism. Therefore, the plating metal 2 is supplied from a port of the supply nozzle 5'.

The gas having a temperature higher than a melting point of the plating metal is blown on the plating metal 2 from the gas supply port 10. The gas for use generally has a temperature which is higher than the melting point by a range of 50° to 150° C. but is lower than the boiling point of the plating metal. Where the plating metal is, e.g., Zn, normally a gas of 500° C. or above is employed. The plating metal is molten by this high temperature gas, and a resultant molten metal (A) is forced to be carried away toward the steel strip 3 at a constant velocity of flow by undergoing a further gas blow, thus forming the liquid metal pool 8 at the corner 7 defined by the discharge nozzle tip and the steel strip surface. The molten plating metal (A) of the liquid metal pool 8 is adhered so as to be upheaved by the upwardly moving steel strip 3, thus forming the plating film 9. As discuused above, according to the invention, the high temperautre gas is blown both for melting of the plating metal and for controlling the velocity of flow of the molten palting metal.

A hot dip zinc plating is carried out on the steel strip by the above mentioned method under, for example, the following conditions.

| | |
|---|---|
| Thickness of Zn-plate (plating metal): | 5 mm |
| Preheat temperature of Zn-plate: | 410° C. |
| Temperature of gas: | 550° C. |
| Flow velocity of gas: | 5 m/s |
| Slit width of ags supply port: | 5 mm |

Figure 10:
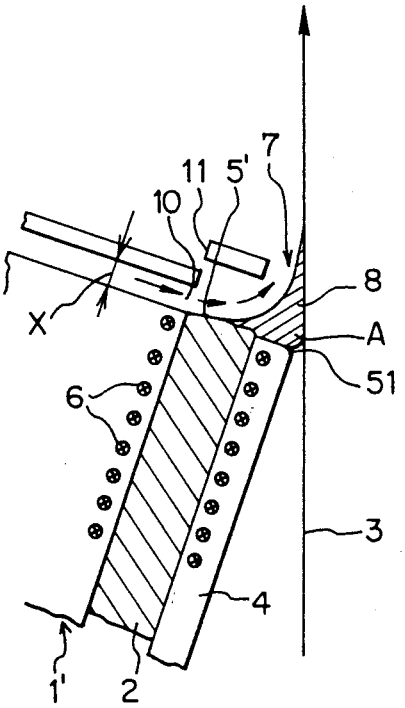
FIGS. 10 and 11 show other embodiments of the invention, where
Figure 11:
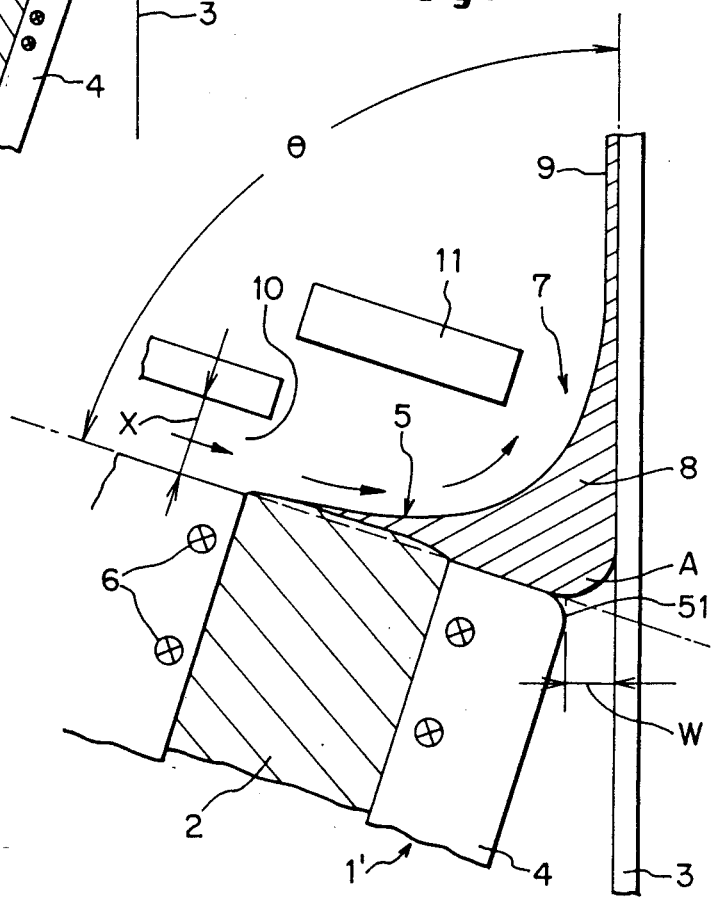

In FIGS. 10 and 11, a heat melting device 11 is disposed outside of and in opposite to a supply nozzle 5', by which the plating metal 2 fed from the supply nozzle 5' are molten. A high temperature gas is, as seen in FIG. 6, blown on the molten plating metal (A), and then carried away towards the steel strip.

The melting of the plating metal 2 may be performed by heating of the heat melting device 11 in combination with the high temperature gas. A structure relative to this case is the same as that shown in FIGS. 10 and 11.

Figure 12:
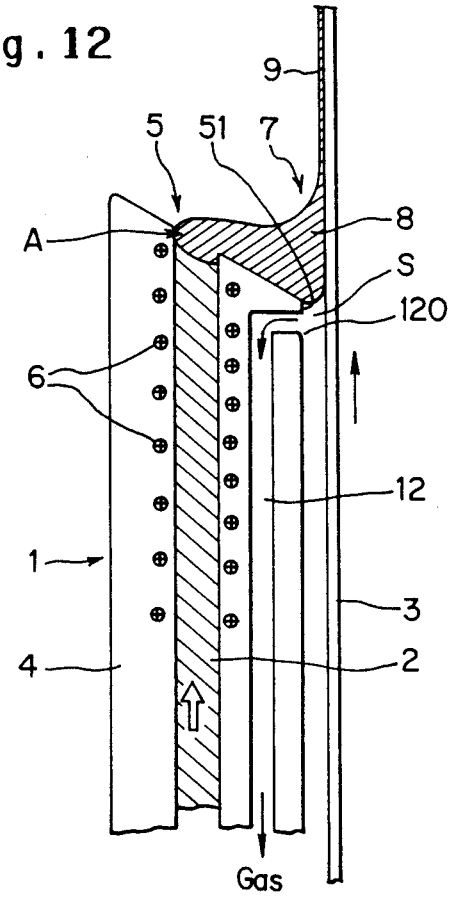
FIGS. 12 and 13 show further embodiments of the invention, where
Figure 13:
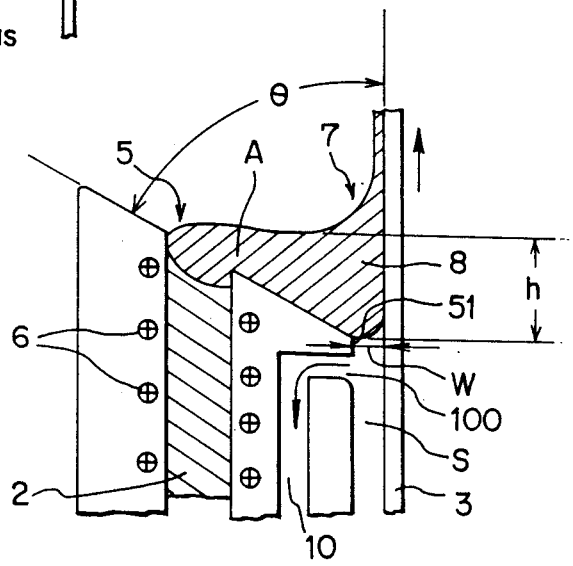

FIGS. 12 and 13 shown the embodiments which suck and exhaust the gas staying under the molten metal pool.

The plating metal supply device 1 includes a degassing passageway 12 formed, at its one end, with an opening 120 to a lower part of a side edge 51 of the discharge nozzle. A gas staying under a plating treatment unit is sucked and exhausted by a sucking device (not shown).

During such a plating process, the gas is drawn away from a space (S) below the liquid metal pool 8 via the degassing passageway 12. The air bubbles are involved into the plating film by a static pressure within the space (S) increasing due to a concomitant gas flow with the steel strip 3. The pressure is reduced by removing the gas to prevent from involving into the plating film. The pressure in the space (S) is preferably kept substanbtially constant, generally around a pressure equivalent to the atmospheric pressure plus the pressure of the height h of the pool.

The concrete contents thereof are the same as referred to in FIG. 1.

Figure 14:
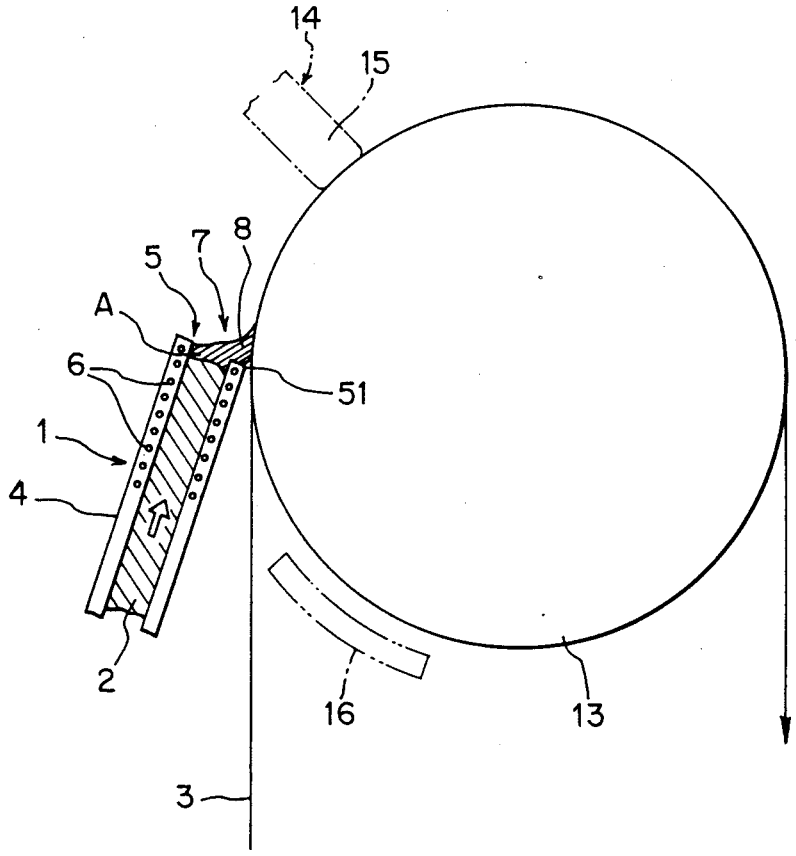
FIGS. 14 and 15 show stillmore further embodiments of the invention, where
Figure 15:
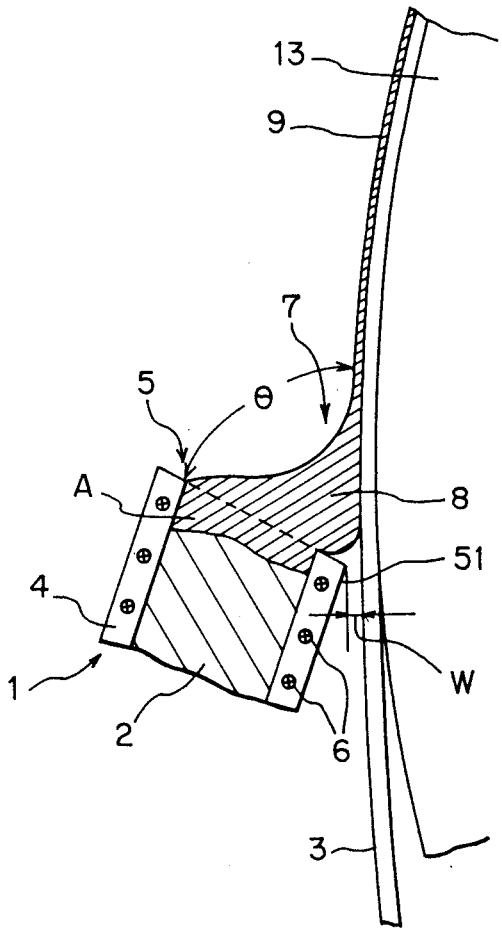

FIGS. 14 and 15 show the embodiments where the rear side of the steel strip is contactd with a rotary body (roll body).

In the metal material supply device 1, a side edge 51 of the discharge nozzle 5 is disposed in opposite to a side of the roll member 13.

The steel strip 3 passes while being coiled on the roll member 13. Then, the steel strip 3 passes upwards such that its underside touches the roll member 10 in close proximity to the side edge 51 of the discharge nozzle.

The molten plating metal (A) discharged from the nozzle form a liquid metal pool 8 at a corner 7 defined by a tip of the discharge nozzle and a surface of the steel strip. The molten plating metal (A) of the pool 8 is so adhered as to be upheaved by the upwardly moving steel strip 3, thus forming a plating film 9.

Figure 16:
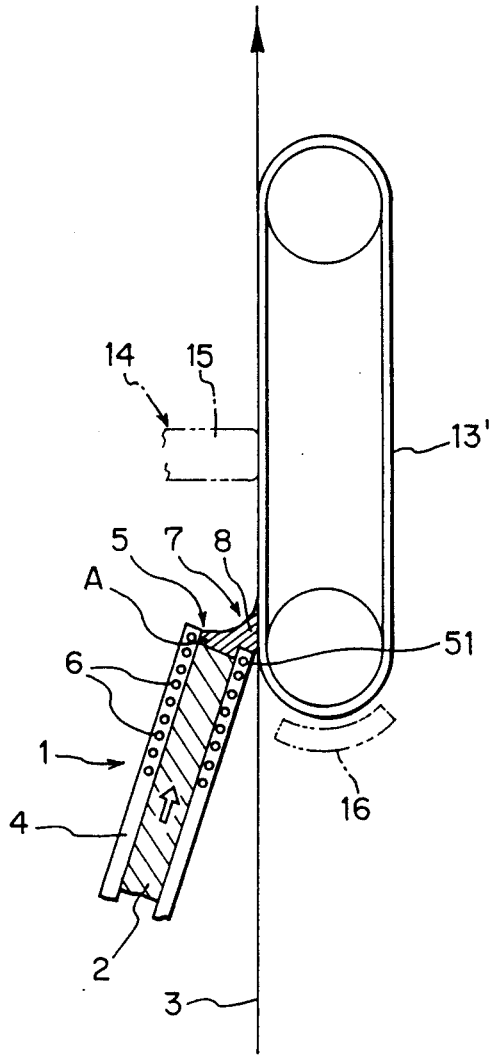

FIG. 16 shows an example where an endless belt 13' is used as a rotary body. One side of the steel strip 3 is brought into contact with an upwardly-directed travelling surface of the endless belt 13', and the steel strip 3 passes in synchronism therewith. The liquid metal pool 8 is formed between the nozzle tip and the other side of the steel strip 3 whose one side is in contact with the belt. Then, plating is formed on the sheet surface.

In accordance with the present embodiment, the plating process can be performed in arbitrary positions of the rotary body and is not limited to those shown in the respective embodiments given above. A direction in which the steel strip is pulled out of the rotary body after practising the plating process can be arbitrarily selected.

In accordance with the invention, the steel strip 3 may undergo the plating process at a normal temperature. In this case, however, non-uniform thermal expansion takes place in the sheet due to a sharp increase in the sheet temperaturte when being in contact with the molten metal, and the sheet will be deformed unpreferably. Prevention of this may be effected by preheating the steel strip 3 at a predetermined temperature (preferably, around the melting point of the plating metal) and practising a plating process on this steel strip.

In the plating film 9, a slight scatter in amount of adhesion is somewhat caused due to vibrations of the steel strip. In order to make this scatter uniform, a uniform treatment is carried out by a surface treatment device. The surface treatment device as an ultrasonic vibrating type (so-called ultrasonic trowel) including, e.g., an ultrasonic vibrator, may be used. The surface treatment device is retained by a cylinder unit having a buffer mechanism, and a vibrating sheet thereof is forced to lightly touch the steel strip surface on which a plating film is formed. The ultrasonic vibrations are imparted to the plating film, whereby a film thickness of the plating metal can be uniform.

FIGS. 14 and 16 show examples where a surface treatment device 14 of such an ultrasonic vibrator is provided, and the number 15 designates the vibrating plate.

The palting treatment based on the method of the invention is carried out preferably in a non-oxidizing atmosphere (e.g., a mixed gas of $H_2$ of 20–25% and $N_2$ of 80–75%) in order to secure plating wetness and adhesion as well. The steel strip surfce is cleansed as much as possible before plating is executed also in the inventive method.

The plating method of the invention can be applied to the platings of various kinds of metals and alloy metals. According to the invention, the steel strip can be subjected to, for instance, Zn plating, Al-Zn alloy plating, Co-Cr-Zn alloy plating (e.g., 1% Co-1% Cr-Zn alloy plating), Al-Mg-Zn alloy plating (e.g., 5% Al-0.6% Mg-Zn alloy plating), Al-Si-Zn alloy plating, (e.g., 55% Al-1.6% Si-Zn alloy plating), Si-Al alloy plating (e.g., 10% Si-Al alloy plating) and Sn-Pb alloy plating (e.g., 10% Sn-Pb alloy plating).

In the embodiments given above, the metal material 2 is supplied to only one side of the steel strip 3. In the case of double-side plating of the steel strip, the devices 1, 1' and the rotary member are disposed on both sides of the steel strip to perform plating on each surface thereof. In this case, plating on both surfaces is not necessarily formed in the same position in the line direction.

Based on the plating method of the invention, when the plating is formed on both surfaces of the steel strip, the plating metal 2 each having a different composition are set on both sides of the steel strip, and double-side heterogeneous plating can be thereby performed with facility. For instance, as an external plate of a house electric appliance or the like, it is possible to acquire a steel strip having one side (a coating surface) formed with an Fe-Zn alloy plating film and the other side (a naked surface) formed with a Zn plating film.

In each of the above mentioned embodiments, the plating metal 2 assuming a sheet shape is employed. Instead, for example a powdery plating metal may be used. In this case, the plating metal 2 is likewise charged in the guide member 4 and fed by a proper feeding means in the direction of the nozzle.

In the embodiments of FIGS. 14 and 16, when the steel strip is preheated, for instance, a surface heating device 16 as shown may be disposed to prevent a drop in temperature of the steel strip.

In accordance with the invention, as said above, the plating films of the molten metal can be formed consecutively on the metal sheet without employing any molten metal bath. The plating method of the invention exhibits the following advantages as compared with the conventional methods using the plating metal bath.

(1) No dross is generated as the plating bath is used, thereby causing no loss of the plating metal other than that attached to the steel strip.

(2) The dross and impurities are not adhered to the surface, and hence the appearance can be kept fine.

(3) Since the plating metal is directly deposited, almost the same components as the plating metal is plated. As a result, the components contained in the plating film become uniform and can be controlled with facility.

(4) It is not required to employ the mechanical members to be immersed in the bath. This eliminates the necessity for stopping the operation to repair or replace the corroded mechanical members.

(5) The roll immersed in the bath are not required, and therefore the appearance is not deteriorated due to the translation of the roll grooves.

(6) It is possible to eliminate the operations of discharging the bottom and top dross and passing the steel sheet into the bath as well as the maintenance of the rolls in the bath, thereby remarkably reducing the burdens on the operators.

(7) In practising various kinds of alloy platings, it is sufficient to only replace the plating metal supplied to the steel strip. Extensive operations to change the bath and move the pot are not needed, and therefore multiple plating processes are practicable with facility.

(8) A wide variety of plating processes such as one-side plating, multi-layerd plating, double-side thickness diferential plating and double-side heterogeneous plating, can readily be performed by selecting and modifying modes of placing and supplying the plating metal and a feeding velocity.

In addition to these advantages, there are provided effects wherein the plating metal can be handled in an extremely easy manner, and the amount of plating adhesion can be controlled on the basis of a velocity at which the solidus plating metal is fed, thereby attaining a high accuracy associated with the adhesion quantity by virtue of a system of feeding the solidus plating metal, melting only an estimated amount of plating metal just before the nozzle and adhering the molten plating metal to the metal sheet.

The sytem of the invention is based not on that the molten plating metal is supplied directly to the metal sheet surface but on that the molten plating metal discharged from the nozzle is temporarily stagnated in the metal pool formed at the corner defined by the nozzle and the metal sheet, and the plating metal of the pool is so adhered as to be upheaved by the upwardly passing metal sheet. Based on this system, even if the metal sheet is vibrated somewhat, the plating film having a constant thickness can be obtained regardless of a gap between the sheet surface and the nozzle. It is not required that the gap between the nozzle and the metal sheet is made minute in terms of a plating thickness order. Hence, even when some vibrations and deterioration in configuration are caused in the metal sheet, the impingement upon the nozzle can be prevented to the greatest possible degree.

In the methods as shown in FIGS. 6 to 11, it is feasible to control the flowing velocity of the molten plating metal at a constant level because of blowing of the high temperature gas, which is supplied towards the steel strip. Thus, the plating film with a uniform thickness can be obtained.

In the methods as shown in FIGS. 12 and 13, the gas staying under the liquid metal pool is sucked and discharged outside, and hence it is possible to adequately prevent the gas from involving into the plating film. As a result, there is obtained a molten plating steel sheet with a high quality but no defect on the surface.

In the method as shown in FIGS. 14 to 16, the underside of the steel strip of the plating treatmetn unit is brought into contact with the rotary body, and it is therefore possible to carry out the plating process while preventing flaps of the steel strip. In consequence, a distribution of the amount of plating adhesion appears uniform, and collision of the nozzle against the sheet is also prevented. It is possible to manufacture a molten plating steel sheet with the uniform amount of adhesion but no defect on the surface.

We claim:

1. A plating method of metal sheets by use of a plating metal supply device having an upwardly-directed nozzle at its top end, comprising the steps of:

passing upwards a metal sheet to be plated in close proximity to one side edge of the upwardly-directed nozzle; successively melting a solidus plating metal from the top ends thereof at its end of or just before a port of said nozzle by heat melting means while successively feeding said solidus plating metal towards said nozzle port within the supply device; supplying a resultant molten plating metal from said nozzle port; forming a pool of the molten plating metal at a corner defined by a metal sheet surface and a tip of the nozzle; adhering the molten plating metal of the pool to the surface of the passing metal sheet; and forming a plating film thereon.

2. The method as claimed in claim 1, determing a space defined by the side edge of the nozzle and the passing metal sheet to be 0.5 to 5 mm.

3. The method as claimed in claim 1, passing the metal sheet in a vertical or oblique direction.

4. The method as claimed in claim 1, carrying out the plating to a preheated metal sheet.

5. The method as claimed in claim 1, carrying out the plating in a non-oxidizing atmosphere.

6. The method as claimed in claim 1, supplying plating metals having different plating components to both surfaces of the metal sheet to perform heterogeneous platings thereon.

7. The method as claimed in claim 1, discharging molten plating metals of different plating components through a plurality of nozzles provided along a thickness direction of the metal sheet so as to form layered pools of molten plating metal, and adhering the molten plating metal of the layered pools to the surface of the passing metal sheet, whereby a plurality of layered plating films or the plating components are distributed in the plating thickness.

8. A plating method of metal sheets by use of a plating metal supply device having a heat melting means of a plating metal and a discharge nozzle at its top end, comprising the steps of:

passing upwards a metal sheet to be plated in close proximity to one side edge of the upwardly-directed discharge nozzle; successively melting a solidus plating metal from the top ends thereof just before a port of said nozzle by said heat melting means while successively feeding said solidus plating metal towards said nozzle port within the supply device; discharging a resultant molten plating metal from said nozzle port; forming a pool of the molten plating metal at a corner defined by a metal sheet surface and a tip of the nozzle; adhering the molten plating metal of the pool to the surface of the passing metal sheet; and forming a plating film thereon.

9. The method as claimed in claim 8, determing a space defined by the side edge of the nozzle and the passing metal sheet to be 0.5 to 5 mm.

10. The method as claimed in claim 8, passing the metal sheet in a vertical or oblique direction.

11. The method as claimed in claim 8, carrying out the plating to a preheated metal sheet.

12. The method as claimed in claim 8, carrying out the plating in a non-oxidizing atmosphere.

13. The method as claimed in claim 8, supplying plating metals having different plating components to both surfaces of the metal sheet to perform heterogeneous platings thereon.

14. The method as claimed in claim 8, discharging molten plating metals of different plating components through a plurality of nozzles provided along a thickness direction of the metal sheet so as to form layered pools of molten plating metal, and adhering the molten plating metal of the layered pools to the surface of the passing metal sheet, whereby a plurality of layered plating films or the plating components are distributed in the plating thickness.

15. A plating method of metal sheets by use of a plating metal supply device having a heat melting means of a plating metal and a discharge nozzle at its top end, comprising the steps of:

passing upwards a metal sheet to be plated in close proximity to one side edge of an upwardly-directed discharge nozle; successively melting a solidus plating metal from the top ends thereof just before a port of the discharge nozzle by the heat melting means while successively feeding the solidus plating metal towards the discharge nozzle port within the supply device; discharging a resultant molten plating metal from said discharge nozzle port; blowing a gas having a temperature higher than a melting point of the plating metal on the discharged molten plating metal in the direction of a metal sheet from the side of the discharge nozzle port; carrying away the molten plating metal towards the metal sheet; forming a pool of the molten plating metal at a corner defined by a metal sheet surface and a tip of the nozzle; adhering the molten plating metal of the pool to the surface of the passing metal sheet; and forming a plating film thereon.

16. The method as claimed in claim 15, determing a space defined by the side edge of the nozzle and the passing metal sheet to be 0.5 to 5 mm.

17. The method as claimed in claim 15, passing the metal sheet in a vertical or oblique direction.

18. The method as claimed in claim 15, carrying out the plating to a preheated metal sheet.

19. The method as claimed in claim 15, carrying out the plating in a non-oxidizing atmosphere.

20. The method as claimed in claim 15, supplying plating metals having different plating components in both surfaces of the metal sheet to perform heterogeneous platings thereon.

21. The method as claimed in claim 15, discharging molten plating metals of different plating components through a plurality of nozzles provided along a thickness direction of the metal sheet so as to form layered pools of molten plating metal, and adhering the molten plating metal of the layered pools to the surface of the passing metal sheet, whereby a plurality of layered plating films or the plating components are distributed in the plating thickness.

22. A plating method of metal sheets by use of a plating metal supply device having a preheat means of a plating metal and the supply nozzle at its top end, comprising the steps of:

passing upwards a metal sheet to be plated in close proximity to one side edge of an upwardly-directed supply nozzle; feeding the plating metal to a supply nozzle while preheating the plating metal by the preheating means within the supply device; supplying a solidus plating metal from a nozzle port; blowing a gas having a temperature higher than a melting point of the plating metal on the supplied plating metal in the direction of a metal sheet from the side of said supply nozzle port; melting the plating metal; carrying away a resultant molten plating metal in the direction of the metal sheet; forming a pool of the molten plating metal at a corner defined by a metal sheet surfce and a supply nozzle tip; adhering the molten plating metal of the pool to the sheet surface; and forming a plating film thereon.

23. The method as claimed in claim 22, wherein a temperature of the gas is higher than the melting point by a range of 50° to 150° C. but is lower than the boiling point of the plating metal.

24. The method as claimed in claim 22, determing a space defined by the side edge of the nozzle and the passing metal sheet to be 0.5 to 5 mm.

25. The method as claimed in claim 22, passing the metal sheet in a vertical or oblique direction.

26. The method as claimed in claim 22, carrying out the plating to a preheated metal sheet.

27. The method as claimed in claim 22, carrying out the plating in a non-oxidizing atmosphere.

28. The method as claimed in claim 22, supplying plating metals having different plating components in both surfaces of the metal sheet to perform heterogeneous platings thereon.

29. The method as claimed in claim 22, discharging molten plating metals of different plating components through a plurality of nozzles provided along a thickness direction of the metal sheet so as to form layered pools of molten plating metal, and adhering the molten plating metal of the layered pools to the surface of the passing metal sheet, whereby a plurality of layered plating films or the plating components are distributed in the plating thickness.

30. A plating method of metal sheets by use of a plating metal supply device having a preheat means of a plating metal and the supply nozzle at its top end, comprising the steps of:

passing upwards a metal sheet to be plated in close proximity to one side edge of an upwardly-directed supply nozzle; feeding the plating metal to a supply nozzle while preheating the plating metal by the preheating means within the supply device; supplying a solidus plating metal from a nozzle port; successively melting the supplied plating metal by means of a heat melting means provided outwardly of the nozzle port; blowing a gas having a temperature higher than a melting point of the plating metal on the supplied plating metal in the direction of a metal sheet from the side of said supply nozzle port; carrying away the molten plating metal in the direction of the metal sheet; forming a pool of the molten plating metal at a corner defined by a surface of the metal plate and a tip of the supply nozzle; adhering the molten plating metal of the pool to the metal sheet surface; and forming a plating film thereon.

31. The method as claimed in claim 30, determing a space defined by the side edge of the nozzle and the passing metal sheet to be 0.5 to 5 mm.

32. The method as claimed in claim 30, passing the metal sheet in a vertical or oblique direction.

33. The method as claimed in claim 30, carrying out the plating to a preheated metal sheet.

34. The method as claimed in claim 30, carrying out the plating in a non-oxidizing atmosphere.

35. The method as claimed in claim 30, supplying plating metals having different plating components in both surface of the metal sheet to perform heterogeneous platings thereon.

36. The method as claimed in claim 30, discharging molten plating metals of different plating components through a plurality of nozzles provided along a thickness direction of the metal sheet so as to form layered pools of molten placing metal, and adhering the molten plating metal of the layered pools to the surface of the passing metal sheet, whereby a plurality of layered plating films or the plating components are distributed in the plating thickness.

37. A plating method of metal sheets by use of a plating metal supply device having a preheat means of a plating metal and the supply nozzle at its top end, comprising the steps of:

passing upwards a metal sheet to be plated in close proximity to one side edge of an upwardly-directed supply nozzle; feeding a solidus plating metal to the supply nozzle port while preheating the plating metal by the preheating means within the supply device; supplying the solidus plating metal from a nozzle port; heating the supplied plating metal by means of a heat melting provided outwardly of the nozzle port; blowing a gas having a temperature higher than a melting point of the plating metal on the supplied plating metal in the direction of a metal sheet from the side of said supply nozzle port to melt the plating metal; carrying away a resultant molten metal with the high temperature gas in the direction of the metal sheet; forming a pool of the molten plating metal at a corner defined by a surface of the metal plate and a tip of the supply nozzle; adhering the molten plating metal of the pool to the metal sheet surface; and forming a plating film thereon.

38. The method as claimed in claim 37, wherein a temperature of the gas is higher than the melting point by a range of 50° to 150° C. but is lower than the boiling point of the plating metal.

39. The method as claimed in claim 37, determing a space defined by the side edge of the nozzle and the passing metal sheet to be 0.5 to 5 mm.

40. The method as claimed in claim 37, passing the metal sheet in a vertical or oblique direction.

41. The method as claimed in claim 37, carrying out the plating to a preheated metal sheet.

42. The method as claimed in claim 37, carrying out the plating in a non-oxidizing atmosphere.

43. The method as claimed in claim 37, supplying plating metals having different plating components in both surfaces of the metal sheet to perform heterogeneous platings thereon.

44. The method as claimed in claim 37, discharging molten plating metals of different plating components through a plurality of nozzles provided along a thickness direction of the metal sheet so as to form layered pools of molten plating metal, and adhering the molten plating metal of the layered pools to the surface of the passing metal sheet, whereby a plurality of layered plating films or the plating components are distributed in the plating thickness.

45. A plating method of metal sheets by use of a plating metal supply device having a heat melting means of a plating metal and the discharge nozzle at its top end, comprising the steps of:

passing upwardly a metal sheet to be plated in close proximity to one side edge of an upwardly-directed discharge nozzle; successively melting the solidus plating metal from the top ends thereof just before a port of the discharge nozzle by the heat melting means while successively feeding the solidus plating metal towards the discharge nozzle port within the supply device; discharging a resultant molten plating metal from the discharge nozzle port; forming a pool of the molten plating metal at a corner defined by a metal sheet surface and a tip of the discharge nozzle; adhering the molten plating metal of the pool, as a plating film, to the surface of the metal sheet to be passed; and suction-discharging a gas outside which exists in a space between the metal plate and discharge nozzle below the pool during a plating process.

46. The method as claimed in claim 45, determing a space defined by the side edge of the nozzle and the passing metal sheet to be 0.5 to 5 mm.

47. The method as claimed in claim 45, passing the metal sheet in a vertical or oblique direction.

48. The method as claimed in claim 45, carrying out the plating to a preheated metal sheet.

49. The method as claimed in claim 45, carrying out the plating in a non-oxidizing atmosphere.

50. The method as claimed in claim 45, supplying plating metals having different plating components in both surfaces of the metal sheet to perform heterogeneous platings thereon.

51. The method as claimed in claim 45, discharging molten plating metals of different plating components through a plurality of nozzles provided along a thickness direction of the metal sheet so as to form layered pools of molten plating metal, and adhering the molten plating metal of the layered pools to the surface of the passing metal sheet, whereby a plurality of layered plating films or the plating components are distributed in the plating thickness.

52. A plating method of metal sheets by use of a plating metal supply device having a heat melting means of a plating metal and the discharge nozzle at its top end, comprising the steps of:

passing upwardly a metal sheet to be plated in close proximity to one side edge of an upwardly-directed discharge nozzle as contacting the rear side to a rotary body at a periphery velocity in synchronism with the passing speed of the metal sheet; successively melting the solidus plating metal from the top ends thereof just before a port of the discharge nozzle by the heat melting means while successively feeding the solidus plating metal towards the discharge nozzle port within the supply device; discharging a resultant molten plating metal from the discharge nozzle port; forming a pool of the molten plating metal at a corner defined by a metal sheet surface and a tip of the discharge nozzle; adhering the molten plating metal of the pool, as a plating film, to the surface of the passing metal sheet; and suction-discharging a gas outside which exists in a space between the metal plate and discharge nozzle below the pool during a plating process.

53. The method as claimed in claim 52, wherein a rotary body is a roll member.

54. The method as claimed in claim 52, wherein a rotary body is an endless belt.

55. The method as claimed in claim 52, determing a space defined by the side edge of the nozzle and the passing metal sheet to be 0.5 to 5 mm.

56. The method as claimed in claim 52, passing the metal sheet in a vertical or oblique direction.

57. The method as claimed in claim 52, carrying out the plating to a preheated metal sheet.

58. The method as claimed in claim 52, carrying out the plating in a non-oxidizing atmosphere.

59. The method as claimed in claim 52, supplying plating metals having different plating components in both surfaces of the metal sheet to perform heterogeneous platings thereon.

60. The method as claimed in claim 52, discharging molten plating metals of different plating components through a plurality of nozzles provided along a thickness direction of the metal sheet so as to form layered pools of molten plating metal, and adhering the molten plating metal of the layered pools to the surface of the passing metal sheet, whereby a plurality of layered plating films or the plating components are distributed in the plating thickness.

* * * * *